United States Patent [19]

Ebihara

[11] Patent Number: 4,502,429

[45] Date of Patent: Mar. 5, 1985

[54] INERTIA DRIVE TYPE STARTER FOR INTERNAL COMBUSTION ENGINE

[75] Inventor: Kōhei Ebihara, Katsuta, Japan

[73] Assignee: Hitachi, Ltd., Tokyo, Japan

[21] Appl. No.: 433,262

[22] Filed: Oct. 7, 1982

[30] Foreign Application Priority Data

Oct. 9, 1981 [JP] Japan ..... 56-160215

[51] Int. Cl.[3] ..... F02N 17/00

[52] U.S. Cl. ..... 123/179 J; 74/7 R

[58] Field of Search ..... 723/179 J; 74/7 R, 7 B, 74/7 C; 192/114 R

[56] References Cited

U.S. PATENT DOCUMENTS

| | | | |
|---|---|---|---|
| 1,341,658 | 6/1920 | Millward | 74/7 R |
| 2,052,127 | 8/1936 | Callsen | 123/179 J |
| 2,923,162 | 2/1960 | Rainey . | |
| 3,177,368 | 4/1965 | Seilly | 74/7 R |
| 3,232,123 | 2/1966 | Wheatley | 74/7 R |
| 3,399,575 | 9/1968 | Seilly et al. | 74/7 R |
| 3,399,576 | 9/1968 | Seilly et al. | 74/7 R |
| 3,572,133 | 3/1971 | Giometti | 74/7 R |

*Primary Examiner*—Parshotam S. Lall

*Attorney, Agent, or Firm*—Antonelli, Terry & Wands

[57] ABSTRACT

An inertia starter for an internal combustion engine comprises a driving shaft driven by a DC motor and provided with a one-way clutch which includes an axially movable driving member rotating and axially moving as the driving shaft is rotated and a driven member driven by the driving member to be axially displaced together with the driving member, a pinion secured to the driven member, an engine ring gear adapted to removably engage with the pinion, a return spring for returning the one-way clutch together with the pinion to the original position, a rotatable holder plate provided on the one-way clutch, and an electromagnet mounted on a stationary portion in opposition to the holder plate with a predetermined distance therefrom. The electromagnet has a coil connected in parallel with the field winding of the DC motor or with a part of the armature winding thereof.

6 Claims, 8 Drawing Figures

INERTIA DRIVE TYPE STARTER FOR INTERNAL COMBUSTION ENGINE

BACKGROUND OF THE INVENTION

Field of the Invention

The present invention relates to an improvement of an inertia drive type starter for an internal combustion engine.

DESCRIPTION OF THE PRIOR ART

The inertia drive type starter is generally employed for starting operation of a machine such as a motor vehicle which incorporates an internal combustion engine as a prime mover. For starting the internal combustion engine (hereinafter referred to simply as the engine), the crank shaft of the engine has to be rotated with the aid of the starter until a minimum number of rotations has been attained at which the engine is able to perform the rotational operation by itself. Since the starter operation is no more required when the engine operation has been started, it is preferred that the starter be of light weight and small size so that the space occupied by the starter is reduced to a minimum. The starter known as the inertia drive type starter is suited to this end because of the simplified structure and outer appearance or configuration as well as the facilitated handling. However, the starter of this type suffers such a serious drawback that premature disengagement of the starter pinion is frequently brought about. More specifically, generally in the engine provided with the inertia drive type starter, engagement and disengagement between the pinion provided on the side of the starter and an engine ring gear are effected by making use of an axial thrust of a helical spline. In this case, when a rapid increase occurs in the rotational speed of the ring gear even transiently or instantaneously for some cause such as false start or spasmodic firing in the engine cylinders, the pinion is subjected to a return force to prematurely disengage from the ring gear, under the action of the helical spline and an instability in the operation of the one-way or overrunning clutch occurs such that a driving member of the clutch is driven by a member which is inherently to be driven, which results in difficulty in effecting the engine starting operation smoothly and reliably in a stable manner. To deal with this problem, various measures have heretofore been proposed.

Figure 1:
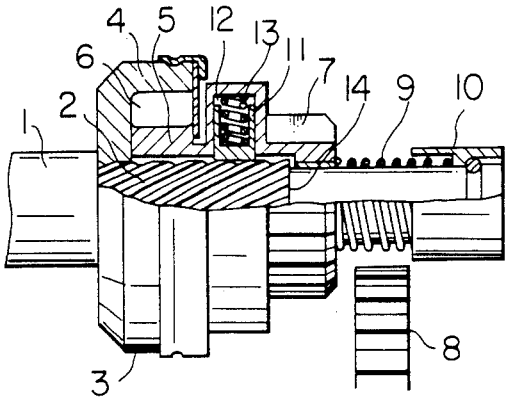
FIG. 1 PRIOR ART
FIGS. 1, 2 and 3 are partially sectioned side views showing main portions of hitherto known inertia drive type starters.

By way of example, FIG. 1 shows a hitherto known inertia drive type starter implemented in such a structure that a centrifugal element is caused to drop in an offset portion formed in a driving shaft in the state in which the pinion meshes with the ring gear, to thereby prevent the pinion from being returned until the engine has attained a predetermined rotational speed. More specifically, referring to FIG. 1, a driving shaft 1 coupled to a DC motor (not shown) is provided with a helical spline 2 with which a driving member 4 of a one-way clutch or overrunning clutch 3 is screwwise engaged. A reference numeral 5 denotes a driven member of the clutch 3 which is formed integrally with a pinion 7 and adapted to be driven by the driving member 4 through interposed rollers 6. Numeral 8 denotes an engine ring gear to be meshed with the pinion 7, and 9 denotes a pinion return spring disposed between a bearing 10 of the driving shaft 1 and the pinion 7. The centrifugal element designated by a reference numeral 11 is inserted in a radial bore 12 formed in the driven member 5 of the clutch and usually urged to the peripheral surface of the driving shaft 1 under the influence of a spring 13. When the pinion 7 is displaced to mesh with the ring gear 8, the centrifugal element 11 is caused to drop in the offset portion 14 formed in the driving shaft 1. This centrifugal element 11 serves to prevent the pinion 7 from being displaced or disengaged from the ring gear 8 until the driven member 5 has attained the predetermined engine starting speed at which the urging or biasing force of the spring 13 is overcome by the centrifugal force exerted onto the centrifugal element 11, whereby the premature disengagement of the pinion from the ring gear is prevented. In this conjunction, it is an experimentally established fact that the engine speed as caused by the aforementioned spasmodic firing tends to be higher than the rotational speed of the engine in the stable state. Accordingly, in the case of the premature disengagement preventing structure mentioned above, there arises a danger that the centrifugal force of the centrifugal element 11 produced upon the spasmodic firing might overcome the urging force of the spring 13 to thereby cause the pinion to be prematurely disengaged from the ring gear, resulting in instability in the starting operation of the engine. When the urging or pressing force of the spring 13 is increased with an attempt to remove the trouble mentioned above, there may then occur another troublesome factor such that the pinion remains as engaged with the ring gear to continue to rotate even after the engine has attained the predetermined starting speed. A starter of the type illustrated in FIG. 1 is disclosed, for example, in Japanese Utility Model Publication No. 21415/63.

Figure 2:
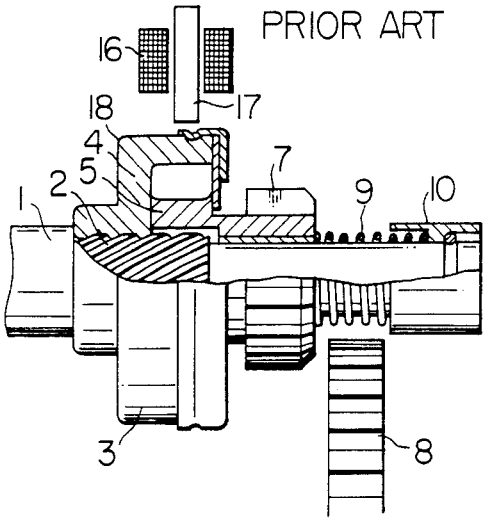
FIG. 2 PRIOR ART

Another example of the hitherto known inertia drive type starter is shown in FIG. 2 in which similar or same parts as those shown in FIG. 1 are denoted by the same reference numerals. In this structure, a plunger 17 of an electromagnet device 16 is caused to bear against a side wall 18 of the driving member 4 of the one-way clutch 3 after the pinion 7 has been engaged with the ring gear 8, to thereby prevent the premature disengagement of the pinion 7. This structure is however disadvantageous in that a delay in manual deenergizing of the electromagnet would bring about an excessively increased rotation of the DC motor due to the instability in the operation of the one-way or overrunning clutch mentioned above, to eventually injure the DC motor. Besides, the plunger 17 would be subjected to excessive abrasion. The starter of this kind is disclosed, for example, in U.S. Pat. No. 2,505,334.

Figure 3:
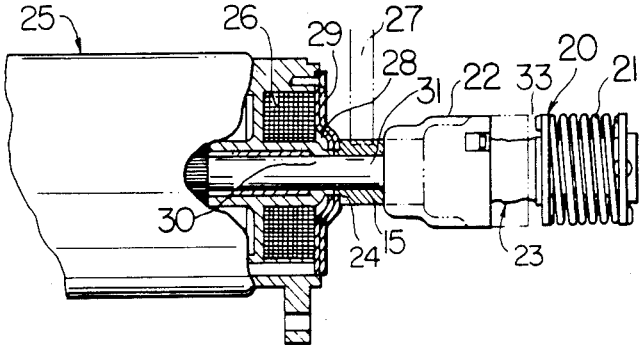
FIG. 3 PRIOR ART
Figure 4:
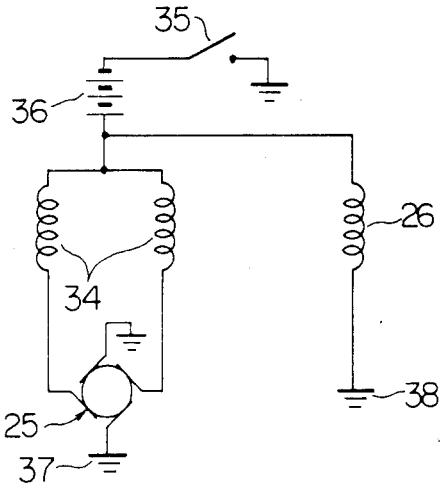
FIG. 4 PRIOR ART
FIG. 4 shows an electrical wiring diagram of a starter motor and an electromagnet of the starter shown in FIG. 3.

FIG. 3 shows the structure of an inertia drive type starter which is disclosed in U.S. Pat. No. 2,923,162 and believed to be very relevant to the present invention, and FIG. 4 shows an electrical wiring diagram of a starter motor (DC series motor) and a solenoid coil. Referring to FIG. 3, a Bendix gear 20 is mounted on a lead screw 13 with a spring 21. The lead screw 23 is connected to an armature shaft 31 of a starter motor 25. An internally threaded member 22 mates with the threads of the lead screw 23 and is axially movable relative to the latter. The member 22 is shown at two positions for indicating displacement thereof, one of which positions is indicated by broken lines. A pinion gear 15 is fixedly mounted on the member 22 and has an integral extension which constitutes a plunger 24. A flywheel (i.e. engine ring gear) 27 is shown, with a lower portion thereof, engaged with the pinion 15, as it occurs when the starter motor is in a driving or starting stage before the engine is started. Referring to FIG. 4, when a switch 35 is closed, a current flows from a battery 36 to the ground 37 through field coils 34 and the motor 25 along one branch of a parallel circuit on one hand and through a coil 26 of an electromagnet to the ground 38 along the other path on the other hand. In consequence, a full battery voltage is applied across the coil 26, whereby a strong toroidal field is produced in gaps 28 and 30.

In operation, a current is caused to flow through the field and the armature of the starter motor 25 to impart rotation to the armature shaft 31. The lead screw 23 is rotated with the shaft 31. However, the member 22 of a heavy structure or mass exhibits a strong tendency to remain stationary and thus rotates at a speed much lower than that of the lead screw 23, which results in that a leftward linear motion is imparted to the member 22, whereby the pinion 15 is brought into engagement with the flywheel (engine ring gear) 27, to cause the latter to be rotated. Further, the plunger 24 is caused to enter an end plate 29 and held by the magnetic circuit along with the pinion 15 in the engaged state, while the current continues to flow through the coil 26 to maintain the starter motor in the energized state. When the engine rotation has attained a predetermined speed at which the engine operation is sustained by itself, the plunger 24 held in the engaged state causes the member 22 and the lead screw 23 to be rotated at a higher speed than the armature shaft 31, being allowed by a ratchet gear 33 which permits relative rotation between the lead screw 23 and the armature shaft 31 only in one direction. When the starter motor is deenergized, the pinion 15 is completely disengaged from the flywheel 27, whereby the former is caused to rotate at a higher speed than the lead screw 23 to thereby impart the rightward motion to the pinion 15.

With the starter described above in conjunction with FIGS. 3 and 4, the problem which the starter shown in FIG. 1 suffers can certainly be solved. However, the difficulty similar to that of the starter shown in FIG. 2 is still involved. More specifically, since the coil 26 of the electromagnet is connected in parallel with the starter motor 25, the engagement between the pinion 15 and the flywheel 27 is maintained under power supply from the battery 36 so long as the switch 35 is kept closed. Accordingly, when the switch 35 is opened with a delay relative to a time point at which the predetermined engine starting speed has been attained, not only the ratchet 33 will be undesirably abraded by the screw 23 but also the pinion 15 and the shaft 31 will undergo abrasion due to difference in the rotational speed between these two members. Even if the delay is of a short duration, the abrasion of the ratchet 33, the pinion 15 and the shaft 31 will never be negligible, when the delayed opening of the switch 35 is repeated frequently, to eventually impede the normal operation of the starter.

SUMMARY OF THE INVENTION

It is an object of the present invention to provide an inertia drive type starter for an internal combustion engine which is immune to the disadvantages of the prior art starters and is capable of maintaining certainly the engagement between the pinion and the engine ring gear until the engine operation has been satisfactorily started, while disengaging automatically and surely the pinion from the engine ring gear to thereby prevent the starter motor from being driven at a higher speed by the engine.

In view of the above object, there is provided according to a general aspect of the present invention an inertia drive type starter for an internal combustion engine which comprises an electromagnet disposed stationarily and adapted to magnetically attract and hold a holder plate rotatably installed on an overrunning or one-way clutch after the engagement between the pinion and the engine ring gear, to thereby prevent the pinion from being prematurely disengaged from the ring gear, while the coil of the electromagnet is connected in parallel with the field coil or a part of the armature coil of the starter motor so that when the starter motor becomes under no-load, the attractive force of the electromagnet may disappear, whereby the pinion is automatically disengaged from the engine ring gear under the influence of a pinion return spring.

DESCRIPTION OF THE PREFERRED EMBODIMENTS

Now, the invention will be described in conjunction with preferred embodiments shown in the drawings.

Figure 5:
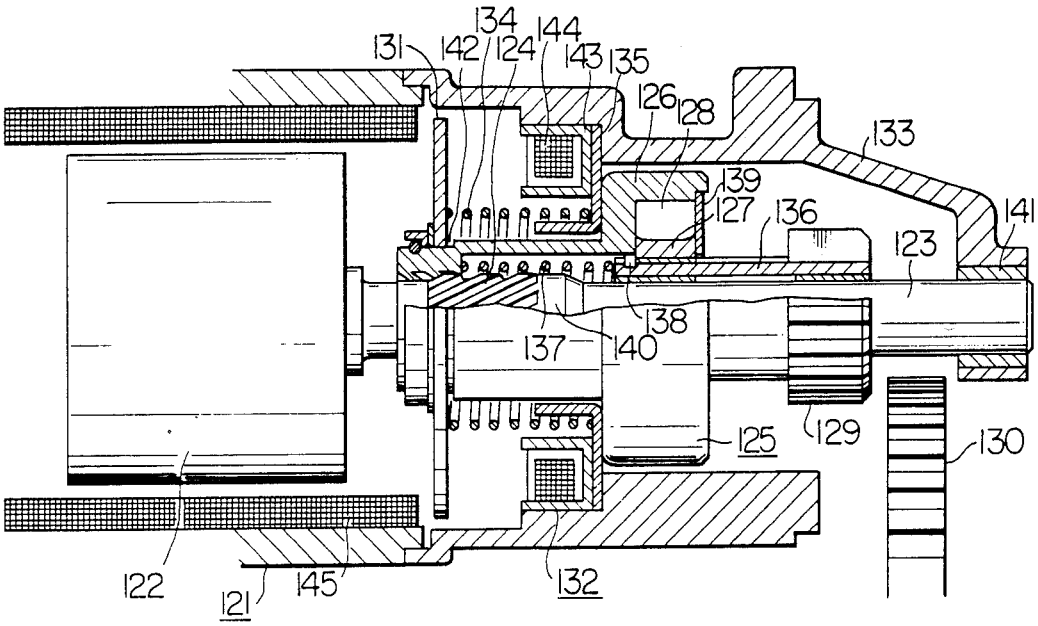
FIG. 5 is a partially sectioned side elevational view showing an inertia drive type starter according to an embodiment of the present invention.

Referring to FIG. 5, a rotatable shaft of an armature 122 of a DC motor 121 has an extension which constitutes a driving shaft 123 provided with a helical spline 124. A driving member 126 of a one-way clutch or an overrunning clutch 125 has an internally threaded portion and mates with the threads of the helical spline 124. A reference numeral 127 denotes a driven member which constitutes another part of the clutch 125 and is adapted to be driven by the driving member 126 through rollers 128 so that the driven member 127 is axially displaced together with the driving member 126. A pinion 129 is mechanically connected to the driven member 127. Numeral 130 denotes a flywheel or an engine ring gear adapted to be engaged by the pinion 129 upon cranking operation of the engine. The engine ring gear 130 is coupled to a rotatable shaft (i.e. crank shaft) of the engine. A stationary cover 133 is fixedly secured to a frame of the DC motor 121 and serves to support the driving shaft 123. Further provided at the peripheral rear end portion (left end as viewed in FIG. 5) of the driving member 126 of the clutch 125 is a holder plate 131 which is rotatable in the circumferential direction relative to the driving member 126. Although the holder plate 131 is rotatable in the circumferential direction relative to the driving member 126, the axial movement of the holder plate 131 is limited by a groove 142 formed in the peripheral surface of the driving member 126. An electromagnet 132 is fixedly mounted on the stationary cover 133 in opposition to the holder plate 131 with a predetermined axial distance spaced from the latter. A pinion return spring 134 is disposed between the holder plate 131 and a spring seat 135 fixedly secured to the cover 133.

The pinion 129 is slidably connected to the driven member 127 by means of a key member 136, and a compression spring 137 is inserted between the pinion 129 and the driving member 126. Reference numeral 138 denotes a stopper for the driven member 127, which is provided on the pinion 129. Further, numeral 139 denotes a cover plate fixedly secured to a front end portion of the driving member 126 of the one-way clutch 125 and adapted to bear on the front end surface of the driven member 127. The cover plate 139 acts to return the driven member 127 together with the pinion 129 with the aid of the stopper 138 when the driving member 126 is returned under the action of the return spring 134. Numeral 140 denotes a stopper annulus formed on the driving shaft 123, and 141 denotes a bearing for the driving shaft 123. The electromagnet 132 is composed of a magnetic path 143 and a coil 144 for magnetically attracting the holder plate 131 when energized. Numeral 145 denotes a field winding of the DC motor 121.

Figure 6:
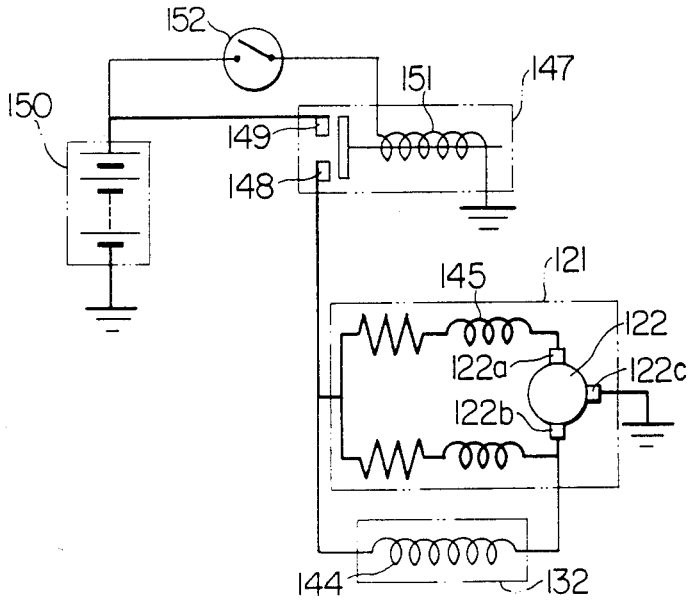
FIG. 6 shows an electrical wiring diagram of a starter motor and an electromagnet of the starter shown in FIG. 5.

Next, referring to FIG. 6, the electric connection or circuit of the starter will be described. Reference numeral 147 denotes a main switch for turning on and off a current supplied to the DC motor 121. This switch 147 has a contact 148 connected to the DC motor 121, a contact 149 connected directly to the battery 150 and a coil 151 which has one end connected to the battery 150 through a start switch 152 and the other end connected to the ground. It will be seen that the coil 144 of the electromagnet 132 is connected in parallel with the field winding 145 of the DC motor 121. The DC motor 121 has brushes **122*a* and 122*b* of positive polarity and a brush 122*c*** of negative polarity. These brushes are in slidable contact with the commutator connected to the armature winding.

With the arrangement described above, when the start switch 152 is closed, the coil 151 of the main switch 147 is energized by the battery 150, whereby the contacts 148 and 149 are closed. In consequence, the field winding 145 of the DC motor 121 and the coil 144 of the electromagnet 132 are energized by the battery 150. Upon operation of the DC motor 121, the driving shaft 123 as well as the helical spline 124 fixedly secured thereto are rotated in accordance with the rotation of the armature 122. However, since the one-way or overrunning clutch 125 is of a heavy construction, it exhibits a strong tendency to remain stationary and is thus rotated at a speed much lower than the helical spline 124. Owing to the difference in the rotational speed between the clutch 125 and the spline 124, the former is imparted with a rightward linear motion as viewed in FIG. 5 and displaced to the right together with the pinion 129 against the compression force of the return spring 134, resulting in that the pinion 129 meshes with the engine ring gear 130. When the teeth of the pinion 129 and the ring gear 130 are not snugly engaged with each other in the initial phase of the displacement, the one-way clutch is caused to move owing to the slide key 136 and the compression spring 137 notwithstanding the blocked state of the pinion 129, whereby the teeth of the pinion 129 and the ring gear 130 are ultimately engaged with each other. The one-way clutch 125 still continues to be displaced until the driving member 126 bears against the stopper annulus 140 of the driving shaft, and the meshing degree of the pinion 129 and the ring gear 130 is increased. In the meantime, the output power of the DC motor 121 is transmitted to the ring gear 130 to start the operation of the engine (not shown). When the driving member 126 is displaced to the stopper annulus 140, the holder plate 131 is also moved toward the electromagnet 132 to thereby define a predetermined gap in cooperation with the magnetic path 143. In this way, the holder plate 131 cooperates with the magnetic path 143 of the electromagnet 132 to form a closed magnetic circuit, whereby the holder plate 131 is attracted by the electromagnet 132, resulting in that the one-way clutch 125 is held at the position at which the pinion 129 and the ring gear 130 are in the mated state. The attractive force exerted onto the holder plate 131 by the electromagnet 132 is so set as to be greater than the sum of the compression force of the pinion return spring 134 and the return power produced upon spasmodic firing in the engine cylinders. Thus, the possibility of the pinion 129 being prematurely disengaged from the ring gear 130 due to the return power produced upon the spasmodic firing is excluded in the initial phase of the engine starting operation. So far as the attractive force of the electromagnet 132 remains unchanged, the meshing state of the pinion and the ring gear is certainly maintained.

The return power produced upon occurrence of the spasmodic firing in the engine cylinders is a force exerted to the one-way clutch 125 in the leftward direction due to an overrunning torque caused when the pinion 129 and hence the driven member 127 is rotated through the ring gear 130 at a higher speed than the driving member 126. The magnitude of the return power is determined by the amount of the overrunning torque and the helical angle of the helical spline 124. In an experiment, the attractive force exerted to the holder plate 131 by the electromagnet 132, i.e. the force for holding the pinion 129 and the ring gear 130 in the meshed state was measured to be 14 Kg when the return power was 3.8 Kg while the effective compression force of the pinion return spring was 1.7 Kg (the initial compression force was set at 1.0 Kg). At that time, the armature current was 75 A, the voltage appearing across the coil 144 was 0.65 V, and the current flowing through the coil 144 was 1.8 A.

Figure 7:
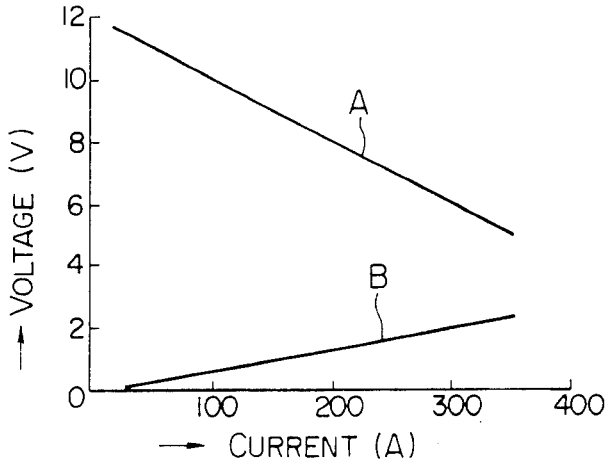
FIG. 7 graphically illustrates changes in voltages applied to the starter motor and the electromagnet shown in FIG. 6 as a function of an armature current.

FIG. 7 illustrates, by way of example, relationship between the voltage across the field winding 145 of the DC motor 121 and the voltage across the coil 144 of the electromagnet 132 connected in parallel with the field winding 145. When the load of the DC motor 121 is large with the motor current being correspondingly large (i.e. when the DC motor is rotating the engine), the voltage across the field winding 145 of the motor 121 by the battery 150 is decreased as indicated by a curve A due to the voltage drop brought about by the internal resistance of the battery 150, while the voltage applied across the coil 144 of the electromagnet 132 is increased as indicated by a curve B. Thus, the current flowing through the coil 144 is considerably large to thereby cause the magnetic attractive force of correspondingly increased magnitude to be produced.

When the engine starts the rotational operation by itself after the cranking operation described above, the load of the DC series motor 121 is rapidly decreased, and the current flowing through the motor 121 is also correspondingly decreased. Then, the voltage across the coil 144 of the electromagnet 132 is decreased, as can be seen from FIG. 7. Thus, the current flowing through the coil 144 is also decreased, whereby the attractive force of the electromagnet 132 becomes decreased. More specifically, when the engine has been successfully started and reached the state to operate by itself without the aid of the starter, load is removed from the DC motor 121 with the voltage applied across the coil 144 being substantially extinguished. This results in that the attractive force of the electromagnet 132 is overcome by the compression force of the pinion return spring 134. As the consequence, the holder plate 131 is moved away from the magnetic path 143 by the return spring 134. The one-way clutch 125 as well as the pinion 129 is then returned to the starting or original position at which the side surface of the driving member 126 bears against the spring seat 135. The pinion is thus disengaged from the engine ring gear 130 and the DC motor 121 continues to rotate under no-load. In this way, no sooner the engine operation has been successfully started than the pinion is automatically disengaged from the engine ring gear without fail, whereby the danger of the DC motor being compelled to rotate at a higher speed by the engine is positively prevented.

The main switch 147 is subsequently deactivated by opening the start switch 152 with the contacts 148 and 149 of the main switch 147 being opened to interrupt the current supply to the DC motor 121 from the battery 150 to stop the DC motor 121. Further, when the start switch 152 is opened in the under-load state of the DC motor 121, the current flow to the electromagnet 132 is interrupted, as a result of which the attractive force of the electromagnet 132 disappears and the pinion 129 is disengaged from the engine ring gear 130. The DC motor 121 is also stopped.

Figure 8:
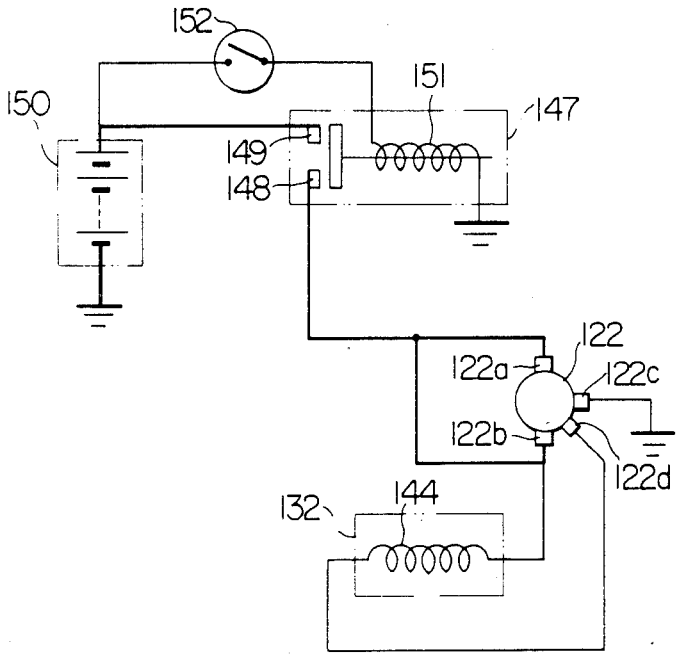
FIG. 8 shows an electrical wiring diagram of a permanent magnet type starter motor and an electromagnet of the inertia drive type starter according to another embodiment of the present invention.

FIG. 8 shows an electric wiring diagram of the starter according to another embodiment of the invention. In this figure, same components as those shown in FIG. 6 are attached with same reference numerals. In this embodiment, the invention is applied to a starter in which a permanent magnet type DC motor is employed. The mechanical structure of this starter differs from that of FIG. 5 only in that the field winding 145 is replaced by a permanent magnet. Accordingly, the coil 144 of the electromagnet 132 can not be connected in parallel with the field winding as is the case of the embodiment of FIGS. 5 and 6. Under the circumstance, an additional brush **122*d* is provided, whereby a part of the armature winding of the permanent magnet type DC motor 121 is connected in parallel with the coil 144 of the electromagnet 132 so that the voltage appearing across the said part of the armature winding is applied to the coil 144. Although the coil 144 is shown as connected between the brush 122*b* (or 122*a*) of positive polarity and the additional brush 122*d*, it will be readily appreciated that the coil 144 may be connected between the brush 122*c* of negative polarity and the additional brush 122*d*. It will be understood that the arrangement shown in FIG. 8** also brings about same advantages as those of the preceding embodiment.

As will be appreciated from the foregoing, the invention has provided an inertia drive type starter in which the engagement between the starter pinion and the engine ring gear is positively maintained regardless of spasmodic firing in the engine cylinders until the engine operation has been successfully started, whereby the premature disengagement of the pinion from the ring gear can be prevented. When the engine has been successfully started and attained the self-sustaining state, the pinion is immediately and automatically disengaged from the ring gear without fail. Thus, the instability of operation of the one-way clutch involves no problem, while the possibility of the starter motor and the associated driving members being caused to rotate at a higher speed by the engine can surely be prevented. By virtue of these features, injuries or damages of the starter motor, seizure of the bearing, abrasion of the driving shaft, deterioration of lubricant of the one-way clutch and the like can be avoided.

I claim:

1. A starter for an internal combustion engine, comprising:

a DC motor;

a driving shaft rotated by said DC motor;

an overrunning clutch provided on said driving shaft and including an axially movable driving member which is rotated and axially moved as said driving shaft is rotated and a driven member which is rotated and axially moved according to the rotation and axial movement of said driving member;

a ring gear fixedly mounted on a rotary shaft of said internal combustion engine, a pinion gear rotatably mounted on said driving shaft and fixedly connected to said driven member so that said pinion gear is axially moved as said driven member is axially moved, to engage with said ring gear;

a stationary member fixedly mounted on a frame of said DC motor and supporting said driving shaft;

an electromagnet fixedly mounted on said stationary member and having a coil applied with a voltage which is in proportion to an armature current of said DC motor, the armature current of said DC motor varying with the loading of said DC motor;

a holder member mounted on said clutch in such a manner so that said holder member is circumferentially rotatably relative to said clutch while limited in axial movement and said holder member is arranged opposite to said electromagnet with a predetermined spacing therebetween so that said holder member is attracted by said electromagnet under attractive force thereof when said pinion gear and said ring gear are in the engaged state; and a spring member disposed between said holder member and a seat member provided on said stationary member for biasing said holder member in a manner so that said holder member is axially moved together with said driving member and said driven member to disengage said pinion gear from said ring gear when the attractive force of said electromagnet is decreased below a predetermined value in accordance with a decrease in the load of said DC motor.

2. A starter for an internal combustion engine according to claim 1, wherein said DC motor is constituted by a series motor including a field winding and an armature winding connected in series to each other, said coil of said electromagnet being connected in parallel with said field winding.

3. A starter for an internal combustion engine according to claim 1, wherein said DC motor is constituted by a permanent magnet motor including a permanent magnet producing field magnetic flux and an armature winding, said coil of said electromagnet being connected in parallel with a part of said armature winding.

4. A starter for an internal combustion engine, comprising:

a DC motor;

a driving shaft rotated by said DC motor;

an overrunning clutch provided on said driving shaft and including an axially movable driving member which is rotated and axially moved as said driving shaft is rotated and a driven member which is rotated and axially moved according to the rotation and axial movement of said driving member;

a ring gear fixedly mounted on a rotary shaft of said internal combustion engine;

a pinion gear rotatably mounted on said driving shaft and fixedly connected to said driven member so that said pinion gear is axially moved as said driven member is axially moved, to engage with said ring gear;

a stationary member fixedly mounted on a frame of said DC motor and supporting said driving shaft;

electromagnetic means fixedly mounted on said stationary member and responsive to an armature current of said DC motor for being energized, the armature current of said DC motor varying with the loading thereof;

a holder member mounted on said clutch in such a manner so that said holder member is circumferentially rotatable relative to said clutch while limited in axial movement and said holder member is arranged opposite to said electromagnet means with a predetermined spacing therebetween so that said holder member is attracted to said electromagnet means when said pinion gear and said ring gear are in the engaged state and said DC motor operates to drive said ring gear by said pinion gear; and a spring member disposed between said holder member and a seat member provided on said stationary member for biasing said holder member in a manner so that said holder member is axially moved together with said driving member and said driven member to disengage said pinion gear from said ring gear when the energization of said electromagnet means is decreased below a predetermined value in response to the DC motor becoming unloaded.

5. A starter for an internal combustion engine according to claim 4, wherein said DC motor is constituted by a series motor including a field winding and an armature winding connected in series to each other, said electromagnet means having a coil connected in parallel with said field winding.

6. A starter for an internal combustion engine according to claim 4, wherein said DC motor is constituted by a permanent magnet motor including a permanent magnet producing field magnetic flux and an armature winding, said electromagnet means having a coil connected in parallel with a part of said armature winding.

* * * * *